United States Patent [19]

Breitmoser et al.

[11] Patent Number: 4,552,209

[45] Date of Patent: Nov. 12, 1985

[54] ARRANGEMENT OF DISCRETE STRUCTURAL PARTS, ESPECIALLY HEAT EXCHANGER

[75] Inventors: Georg Breitmoser, Groebenzell; Wilhelm Vogel, Aystetten, both of Fed. Rep. of Germany

[73] Assignee: MTU-Motoren-und Turbinen-Union Muenchen GmbH, Munich, Fed. Rep. of Germany

[21] Appl. No.: 716,507

[22] Filed: Mar. 25, 1985

Related U.S. Application Data

[63] Continuation of Ser. No. 522,642, Aug. 11, 1983, abandoned.

[30] Foreign Application Priority Data

Aug. 14, 1982 [DE] Fed. Rep. of Germany ..... 3230377

[51] Int. Cl.[4] ..... F28F 19/02

[52] U.S. Cl. ..... 165/133; 165/162; 165/172; 165/178

[58] Field of Search ..... 165/133, 134, 162, 172, 165/178, DIG. 10

[56] References Cited

U.S. PATENT DOCUMENTS

| | | | |
|---|---|---|---|
| 3,554,168 | 1/1971 | Woebcke | 165/162 |
| 3,587,732 | 6/1971 | Burne | 165/164 |
| 3,595,310 | 7/1971 | Burne | 165/164 |
| 3,666,006 | 5/1972 | Valyi | 165/133 |
| 4,249,719 | 2/1981 | Knuppel et al. | 266/99 |
| 4,354,550 | 10/1982 | Modahl et al. | 165/133 |

FOREIGN PATENT DOCUMENTS

| | | | |
|---|---|---|---|
| 117674 | 11/1943 | Australia | 165/133 |
| 421122 | 3/1924 | Fed. Rep. of Germany | 165/165 |
| 810223 | 8/1951 | Fed. Rep. of Germany . | |
| 1233547 | 2/1967 | Fed. Rep. of Germany . | |

*Primary Examiner*—Sheldon J. Richter
*Assistant Examiner*—Randolph A. Smith
*Attorney, Agent, or Firm*—W. G. Fasse; D. H. Kane, Jr.

[57] ABSTRACT

In an arrangement of at least two discrete structural parts in package form which are spaced apart from each other, the individual structural parts are coated at least on one circumference of the structural part with a metal- or ceramic-powder collar. The powder collars serve as spacers between adjacent structural parts, are preferably sprayed on, and reliably prevent fretting corrosion between the structural parts.

5 Claims, 4 Drawing Figures

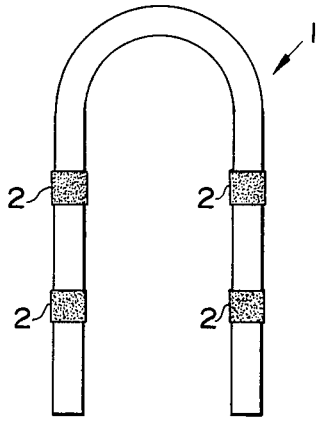
FIG. 1
FIG. 2
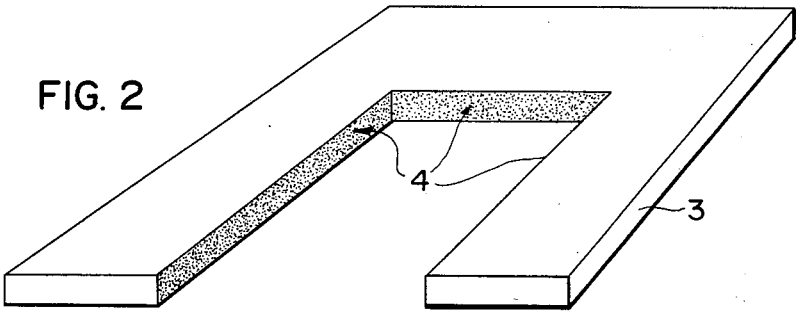
FIG. 3
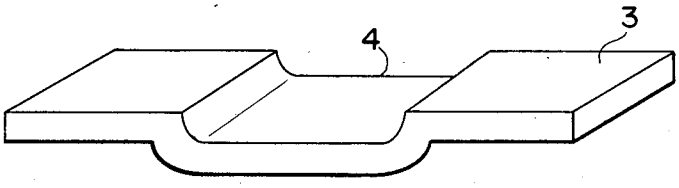

ARRANGEMENT OF DISCRETE STRUCTURAL PARTS, ESPECIALLY HEAT EXCHANGER

This application is a continuation of application Ser. No. 522,642, filed Aug. 11, 1983 now abandoned.

BACKGROUND OF THE INVENTION

The invention relates to an arrangement in package form of at least two discrete structural parts which are spaced apart from each other, especially in heat exchangers.

In heat exchangers according to the prior art, U-shaped lancet tubes are utilized which are secured in the area of the free ends of the U-shanks. A plurality of such structural parts, which are aligned with one another and spaced apart from one another, form in their entirety part of a heat exchanger block. Due to the one-sided securing of the structural parts, difficulties arise in fixing the other end. In certain circumstances, separate lancet tubes might contact each other and cause metallic friction. In order to prevent fretting corrosion between the separate parts, metal shims are used as spacers according to the prior art. The shims must themselves be secured to an (outer) fixed point, and must allow a relative motion between the structural part and the shim to take operational temperature variations into account. Such an arrangement is comparatively expensive and complicated.

OBJECT OF THE INVENTION

It is the object of the invention to provide an arrangement of at least two discrete spaced-apart structural parts of the initially described type, in which a securing aid for the separate structural parts is made possible by simple means. This securing aid should also prevent corrosion of adjacent structural parts due to metallic friction.

SUMMARY OF THE INVENTION

The object of the invention is achieved in that the structural part is coated at least around one circumference with a metal- or ceramic-powder collar. This metallic- or ceramic-powder collar serves simultaneously as a spacer between neighboring structural parts, whereby metal shims are no longer necessary as spacers in heat exchangers. Adjacent structural parts are reliably held a distance apart, so that fretting corrosion is reliably prevented. A further advantage is seen in that the powder to be applied may be selected and applied according to the existing technical requirements.

The structural part particularly comprises at least one sprayed-on metal- or ceramic-powder collar. Such a method of application has been proved to be especially economical.

A powder collar of limited thickness normally contacts the outer circumference of an adjacent structural part at a definite location, in order to establish a spacing between the individual structural parts. The applied layer of the metallic- or ceramic-powder collar may be comparatively thin, if, according to an advantageous further embodiment of the invention, adjacent structural parts possess metal- or ceramic-powder collars at the same elevation or position and the powder collars of adjacent structural parts contact each other. Thereby adjacent structural parts may not only be held a distance apart and secured relative to one another, but in the assembled state of the arrangement only the separate powder collars contact each other, which in operation (for example when temperature differences occur) may be subjected to relative movement. The powder collars are not subject to any fretting corrosion.

With structural parts which are subjected to very high temperatures which lead to expansion or contraction during operation, one preferably uses a metal- or ceramic-powder layer of the same material of which the structural part is made.

The structural parts in a heat exchanger are, for example, U-shaped lancet tubes which are aligned with one another, whereby the complete lancet tube package is preferably enclasped by an outer supporting frame, of which the inner circumference is coated with a metal- or ceramic-layer similar to the powder collars.

It is a special advantage of the invention that one may influence the eigenfrequency of the structural parts to thereby prevent vibration failures through proper powder spray application.

BRIEF FIGURE DESCRIPTION

The invention will now be described in more detail by way of an example embodiment with reference to the drawings, wherein:

FIG. 1 is a schematic side view of a structural part in the form of a cooling tube of a heat exchanger arrangement;

FIGS. 2 and 3 are perspective views of an outer two-piece supporting frame.

Figure 4:
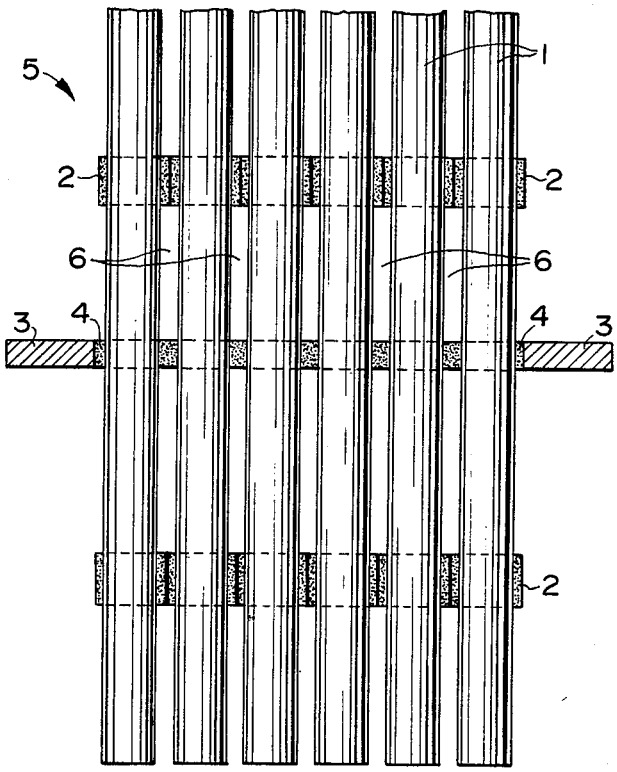
FIG. 4 is a side view of a package of cooling tubes, partial broken away, according to FIG. 1 with a portion of a supporting frame according to FIG. 2.

DETAILED DESCRIPTION OF PREFERRED EXAMPLE EMBODIMENTS AND OF THE BEST MODE OF THE PRESENT INVENTION

A heat exchanger block which itself is of no further interest (not shown in the drawings) comprises discrete structural parts 1 in the form of U-shaped lancet tubes, of which the free shank ends are secured in a support in such a manner that the individual tubes are aligned relative to one another and extend a certain distance apart from one another.

In order to ensure the spacing between the individual tubes, metal- or ceramic-powder collars 2 are provided on each structural part in the area of the shank of the tube. In the example embodiment according to FIG. 1, two collars 2 are applied to each shank and spaced apart from each other. The collars are sprayed onto the outer circumference of the tubes in a suitable manner, to a thickness of $0.4 \pm 0.05$ mm. The identically constructed separate tubes possess powder collars 2 at the same position or elevation so that they face each other. In the complete arrangement of a heat exchanger block adjacent powder collars 2 contact each other directly, so that the tubes themselves are held at a distance apart and are secured if a suitable outer perimeter fastening is provided for the tube package. Hence, it will be noted, the individual tubes cannot make metallic contact among one another; fretting corrosion between the tubes is prevented.

A heat exchanger block comprising structural parts 1 of FIG. 1 may be circumferentially enclasped in the area of a non-secured location of the tubes by an outer supporting frame 3, as shown in FIGS. 2 and 3. The supporting frame is two-pieced for the purpose of mounting and has an inner circumference or surface which is coated with a metal or ceramic layer 4 similar to the powder collars 2 of the structural parts 1. By these means, the non-secured ends of the tubes in their totality are circumferentially braced in such a manner that metallic friction and hence fretting corrosion are avoided due to the metal or ceramic layer 4. The arrangement of the outer supporting frame 3 comprising a supporting fork and a locking bridge, is installed after the full assembly of the tubes at a position where according to the prior art, metal shims which may erode in operation are located.

FIG. 4 shows a side view of a package 5 of cooling tubes 1, partially broken away, according to FIG. 1. A portion of the supporting frame 3 is shown cut away in front to simplify the illustration. The collars 2 face each other and directly contact each other whereby the tubes are spaced from each other to form gaps 6 between neighboring tubes 1. The surface of the supporting or mounting frame 3 contacting the tubes 1 is provided with the above mentioned coating 4 also for preventing fretting corrosion where the frame 3 contacts the tubes 1.

Although the invention has been described with reference to specific example embodiments, it will be appreciated that it is intended to cover all modifications and equivalents within the scope of the appended claims.

We claim:

1. A heat exchanger, comprising a plurality of parallel tubes each having a given tube length and arranged in a package, each of said tubes comprising at least one sprayed-on spacer collar made of a metal or ceramic powder, each spacer collar having a collar length which is substantially shorter than said given tube length for covering only a portion of said given tube length for leaving the tube length outside said spacer collar free, all of said sprayed-on spacer collars of all tubes being located to substantially face each other, said neighboring spacer collars directly contacting each other, said spacer collars having a thickness which together with said collar length forms gaps along said tube length outside said spacer collars and between said tubes forming said package whereby one fluid can pass through the tubes and another fluid can pass through said gaps.

2. The heat exchanger of claim 1, wherein said tubes are made of solid metal or ceramic and wherein said spacer collars are made of the same metal or ceramic but in sprayed-on powder form.

3. The heat exchanger of claim 1, wherein said tubes have a U-shape.

4. The heat exchanger of claim 1, further comprising supporting frame means for said package of tubes, said frame means having an inner, tube facing surface and a sprayed-on coating on said inner tube facing surface for avoiding a direct contact between said tubes and said supporting frame means.

5. The heat exchanger of claim 1, comprising at least two groups of spacer collars, said groups being spaced from each other along the length of the tubes and so located that all tubes are spaced from each other along the entire tube length.

* * * * *